United States Patent [19]

Sato et al.

[11] Patent Number: 4,629,684

[45] Date of Patent: Dec. 16, 1986

[54] HEAT DEVELOPABLE COLOR PHOTOGRAPHIC LIGHT-SENSITIVE MATERIAL WITH DEVELOPMENT ACCELERATOR

[75] Inventors: Kozo Sato; Yoshiharu Yabuki; Ken Kawata; Hiroyuki Hirai, all of Kanagawa, Japan

[73] Assignee: Fuji Photo Film Co., Ltd., Kanagawa, Japan

[21] Appl. No.: 775,291

[22] Filed: Sep. 12, 1985

[30] Foreign Application Priority Data

Sep. 14, 1984 [JP] Japan ..... 59-193468

[51] Int. Cl.[4] ..... G03C 1/40; G03C 5/54

[52] U.S. Cl. ..... 430/559; 430/203; 430/351; 430/617; 430/619; 430/955

[58] Field of Search ..... 430/203, 218, 351, 353, 430/617, 619, 620, 955, 559

[56] References Cited

U.S. PATENT DOCUMENTS 4,499,172 2/1985 Hirai et al. ..... 430/619

4,550,071 10/1985 Aone et al. ..... 430/619

*Primary Examiner*—Richard L. Schilling

*Attorney, Agent, or Firm*—Sughrue, Mion, Zinn, Macpeak, and Seas

[57] ABSTRACT

A heat developable color photographic light-sensitive material comprising a support having thereon at least one layer containing a compound represented by the formula:

$$R—C{\equiv}C—M_{1/k}$$

wherein R represents an unsubstituted or substituted group selected from an alkyl group, cycloalkyl group, an alkenyl group, an alkynyl group, an aralkyl group, an aryl group and a heterocyclic group; M represents a hydrogen atom or a transition metal atom; and k is an integer of 1 to 3. This heat-developable color photographic light-sensitive material provides a high maximum density and a low fog by heat developing at a relatively low temperature and for a short time.

3 Claims, No Drawings

HEAT DEVELOPABLE COLOR PHOTOGRAPHIC LIGHT-SENSITIVE MATERIAL WITH DEVELOPMENT ACCELERATOR

FIELD OF THE INVENTION

The present invention relates to a heat developable color photographic light-sensitive material, i.e., a photographic light-sensitive material forming color images upon heat development.

BACKGROUND OF THE INVENTION

Heat developable photographic light-sensitive materials and a process for forming images using the materials are well known and are described in detail, for example, in *Shashin Kogaku no Kiso* (Fundamentals of Photographic Engineering), pp. 553–555 (Corona Co., Ltd., Tokyo, 1979); *Eizo Joho* (Image Information) p. 40, April, 1978, and *Neblette's Handbook of Photography and Reprography,* PP. 32–33, (Van Nostrand Reinhold Company, 7th Ed. (1977)). For the formation of, in particular, color images, various techniques have been proposed, including a method in which couplers are used as dye providing substances (see U.S. Pat. Nos. 3,531,286, 3,761,270, 4,021,240, Belgian Pat. No. 802,519, and *Research Disclosure,* September, 1975, pp. 31–32), a method in which compounds with a nitrogen-containing heterocyclic ring group introduced in the dye portion are used as dye providing substances (see *Research Disclosure,* May, 1978, pp. 54–58), a method utilizing the silver dye bleaching process (see *Research Disclosure,* April, 1976, pp. 30–32, ibid., December, 1976, pp. 14–15, and U.S. Pat. No. 4,235,957), and a method utilizing leuco dyes (see U.S. Pat. Nos. 3,985,565 and 4,022,617).

These methods, however, have their respective disadvantages. Their common disadvantages are that the development requires relatively long periods of time, images formed have undersirably high fog levels, and the maximum density ($D_{max}$) is low.

In order to overcome the above problems, Japanese Patent Application (OPI) No. 58543/83 (corresponding to U.S. Pat. No. 4,500,626) (the term "OPI" as used herein refers to a "published unexamined patent application") discloses a method using dye providng redox compounds which release hydrophilic dyes. Although this method has succeeded in ameliorating the above disadvantages, it has been desired to obtain a light-sensitive material which can be heat developed at relatively low temperatures, and in short period of time, and in which a high maximum density can be obtained while preventing the formation of fog.

SUMMARY OF THE INVENTION

An object of the present invention is to provide a heat developable color photographic light-sensitive material in which a maximum density as high as possible can be obtained while preventing the formation of fog by heat development at relatively lwo heating temperatures, and for short periods of time.

The above object of the present invention is attained by a heat developable color light-sensitive material comprising a support thereon, having at least a layer containing at least a compound represented by the following general formula:

$$R—C{\equiv}C—M_{1/k}$$

wherein R represents an unsubstituted or substituted substituent selected from an alkyl group, a cycloalkyl group, an alkenyl group, an alkynyl group, an aralkyl group, an aryl group and a heterocyclic group; M represents a hydrogen atom or a transition metal atom; k represents an integer of 1 to 3; and in the above general formula, the alkyl group in R may be straight or branched.

DETAILED DESCRIPTION OF THE INVENTION

Examples of the alkyl group include a butyl group, an isobutyl group, a cyclohexyl group, a heptyl group, an octyl group, a dodecyl group and so on. Examples of substituents in the substituted alkyl group include an alkoxy group (for example, a methoxy group and so on), a hydroxy group, a cyano group, a halogen atom, a sulfonamide group and so on.

Examples of a cycloalkyl group include a cyclopentyl group, a cyclohexyl group, a decahydronaphtyl group and so on. Examples of an alkenyl group include a propenyl group, an isopropenyl group, a stylyl group and so on. Examples of an alkynyl group include an ethynyl group, a phenylethynyl group and so on.

Examples of an aryl group include a phenyl group, a naphtyl group and so on. Examples of a substituent in a substituted aryl group include an alkyl group (a methyl group, a dodecyl group and so on), a cyano group, a nitro group, an amino group, an acylamino group, a sulfonamide group (including one that belongs to an aliphatic group or an aromatic group and that has a heterocyclic group), an alkoxy group, an aryloxy group, an alkoxycarbonyl group, an ureid group, a carbamoyl group, an acyloxy group, a 5-membered or 6-membered heterocyclic group (preferably a heterocyclic group containing at least one nitrogen atom), an alkylsulfonyl group, a hydroxycarbonyl group, a sulfo group, a sulfamoyl group, a halogen atom (fluorine bromine, chlorine, iodine) and so on. These substituents may be substituted. The above substituted group may have at least two of the above-mentioned substituents.

The below-mentioned group can have a substituent selected from the above-mentioned groups. That is, the below-mentioned groups can be substituted with the above-mentioned groups for R.

Examples of an aralkyl group include a benzyl group and a phenethyl group.

As a heterocyclic group, a 5-membered or 6-membered heterocyclic group having at least a hetero atom selected from a nitrogen atom, an oxygen atom and a sulfur atom is preferable. Specific examples include a furan ring group, a thiophene ring group, a pyridine ring group, a quinoline ring group, a thiazole ring group, a benzothiazole ring group and so on. These heterocyclic groups may be single rings or condensed rings thereof.

An acetylene compound such that R is a phenyl group or a substituted phenyl group in the above-mentioned general formula is the most preferable in the present invention.

The compound of the present invention can be used over a wide range of concentrations. An effective range is not more than 50% by weight based on the total weight of the dried coating layer on the support in the light-sensitive material and a preferable range is from 0.01% by weight to 40% by weight.

Specific examples of the acetylene compounds of the present invention are described set forth below:
(1)
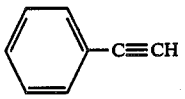
(2)
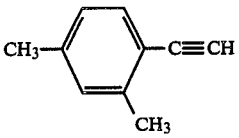
(3)
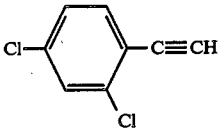
(4)
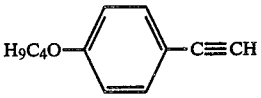
(5)
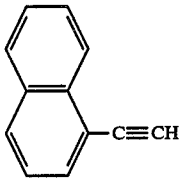
(6)
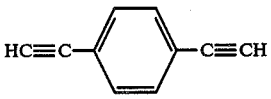
(7)
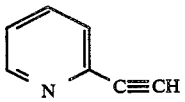
(8)
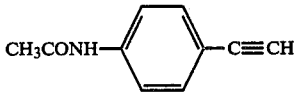
(9)
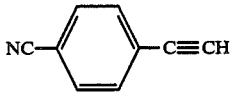
(10)
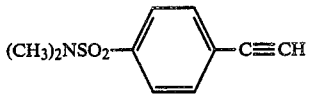
(11)
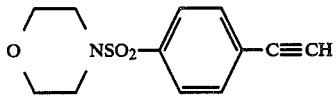
-continued
(12)
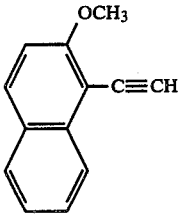
(13)
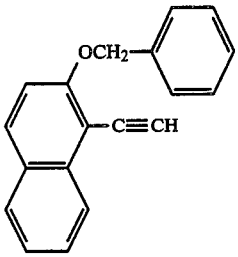
(14)
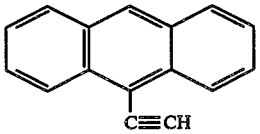
(15)
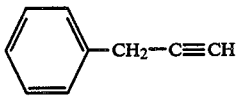
(16)
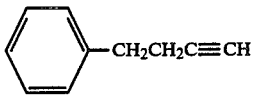
(17)
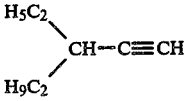
(18)
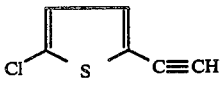
(19)
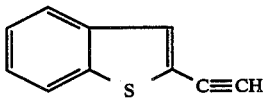
(20)
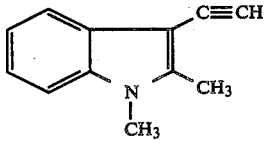
(21)
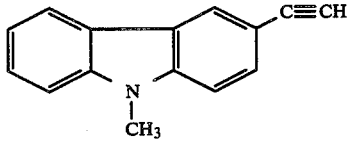

-continued

(22) 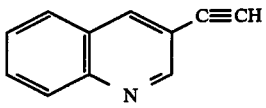

(23) 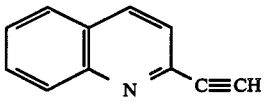

(24) 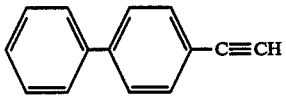

(25) 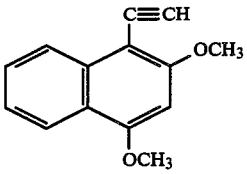

(26) 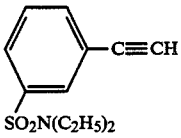

(27) 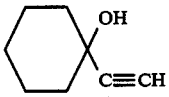

(28) 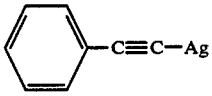

(29) 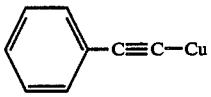

(30) 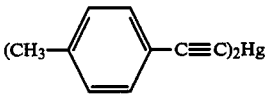

(31) 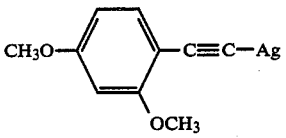

(32) $(H_{31}C_{15}C{\equiv}C)_2Hg$

Now a method of synthesizing an acetylene compound (and a metal salt thereof) of the present invention is described.

The acetylene compound is most generally synthesized by a reaction of releasing a hydrogen halogenide by use of a dihalogenic compound in which two halogen atoms respectively combine with each of two carbon atoms neighbouring each other on same carbon atoms, or a base of a halogeno-olefine compound.

In addition, the following synthesis methods are used: a method of treating with a base, following a reaction of a carbonyl compound and pentachlorophosphate, a method of dehalogenating a 1,2-dihalogenicalkene by use of zinc, a method using a phosphate compound and a method using a fragmentation reaction. These methods are described in detail in *Shin Jikken Kagaku Koza* (Lecture of New-Synthetic Chemistry), pp. 253–306 (Maruzen Co., Ltd., Tokyo, (1977)). A method of synthsizing a metal salt of an acetylene compound (acetylide) is also described in the above book.

Examples a boiling point or a melting point of synthesized acetylene compounds are described below.

| Compound No. | Boiling point or melting point (°C.) |
|---|---|
| (1) | bp. 142–144° C. |
| (7) | bp. 176–178° C. |
| (8) | mp. 123–126° C. |
| (10) | mp. 102–103° C. |
| (11) | mp. 166–167° C. |
| (27) | bp. 180° C. |

The effect of the development-accelerating agent of the present invention is particularly remarkable when using a silver halide emulsion as a light-sensitive substance.

The silver halide used in the present invention includes silver chrolide, silver chrolobromide, silver chloroiodide, silver bromide, silver iodobromide, silver chloroiodobromide, silver iodide and so on.

Silver iodobromide as an example of such a silver halide is prepared by first adding a silver nitrate solution to a potassium bromide solution to prepare silver bromide particles and then adding potassium iodide thereto.

According to the present invention, silver can be utilized as an image forming substance. Further, various other image forming substances can be employed in various image forming processes.

For instance, couplers capable of forming color images upon reaction with an oxidation product of a developing agent which are used in liquid development processing widely known hitherto can be employed. For example, as magenta couplers, there are 5-pyrazolone couplers, pyrazolobenzimidazole couplers, cyanoacetylcoumarone couplers and open chain acylacetonitrile couplers, etc. As yellow couplers, there are acylacetamide couplers (for example, benzoylacetanilides and pivaloylacetanilides), etc. As cyan couplers, there are naphthol couplers and phenol couplers, etc. It is preferred that these couplers be nondiffusible substances which have a hydrophobic group called a ballast group in the molecule thereof or be polymerized substances. The couplers may be any of the 4-equivalent type and 2-equivalent type to silver ions. Further, they may be colored couplers having a color correction effect or couplers which release a development inhibitor at development processing (so-called DIR couplers).

Further, dyes for forming positive color images by a light-sensitive silver dye bleach processes, for example, those as described in *Research Disclosure*, No. 14433, pages 30–32 (April, 1976), ibid., No. 15227, pages 14–15 (December, 1976) and U.S. Pat. No. 4,235,957, etc., can be employed.

Moreover, leuco dyes as described, for example, in U.S. Pat. Nos. 3,985,565 and 4,022,617, etc., can be used.

Further, dyes to which a nitrogen-containing heterocyclic group have been introduced as described in *Research Disclosure,* No. 16966, pages 54–58 (May 1978), may be employed.

In addition, dye providing substances which release a mobile dye by utilizing a coupling reaction of a reducing agent oxidized by an oxidation reduction reaction with a silver halide or an organic silver salt at high temperature as described in European Pat. No. 79,056, West German Pat. No. 3,217,853, European Pat. No. 67,455, etc., and dye providing substances which release a mobile dye as a result of an oxidation reduction reaction with a silver halide or an organic silver salt at high temperatures as described in European Pat. No. 76,492A, West German Pat. No. 3,215,485, European Pat. No. 66,282, Japanse Patent Application Nos. 28928/83 and 26008/83, etc., can be employed.

Preferred dye providing substances which can be employed in these processes can be represented by the following general formula (CI):

$$(\text{Dye}—\text{X})_q—\text{Y} \qquad \text{(CI)}$$

wherein Dye represents a dye which becomes mobile when it is released from the molecule of the compound represented by the general formula (CI); X represents a simple bond or a connecting group; Y represents a group which releases Dye in correspondence or counter-correspondence to light-sensitive silver salts having a latent image distributed imagewise, the diffusibility of Dye released being different from that of the compound represented by formula (CI) and q represents an integer of 1 or 2.

The dye represented by Dye is preferably a dye having a hydrophilic group. Examples of the dye which can be used include azo dyes, azomethine dyes, anthraquinone dyes, naphthoquinone dyes, styryl dyes, nitro dyes, quinoline dyes, carbonyl dyes and phthalocyanine dyes, etc. These dyes can also be used in the form of having temporarily shorter wavelengths, the color of which is recoverable in the development processing.

More specifically, the dyes as described in European Pat. No. 76,492A can be utilized.

Examples of the connecting group represented by X include —NR— (wherein R represents a hydrogen atom, an alkyl group, or a substituted alkyl group), —$SO_2$—, —CO—, an alkylene group, a substituted alkylene group, a phenylene group, a substituted phenylene group, a naphthylene group, a substituted naphthylene group, —O—, —SO—, or a group derived by combining together two or more of the foregoing groups.

In the following, preferred embodiments of Y in formula (CI) are described in greater detail.

In one embodiment, Y is selected so that the compound represented by the general formula (CI) is a nondiffusible image forming compound which is oxidized as a result of development, thereby undergoing self-cleavage and releasing a diffusible dye.

An example of Y which is effective for compounds of this type is an N-substituted sulfamoyl group. For example, a group represented by formula (CII) is illustrated for Y.

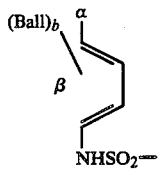

(CII)

wherein β represents non-metallic atoms necessary for forming a benzene ring, which may optionally be fused with a carbon ring or a hetero ring to form, for example, a naphthalene ring, a quinoline ring, a 5,6,7,8-tetrahydronaphthalene ring, a chroman ring or the like;

α represents a group of —$OG^{11}$ or —$NHG^{12}$ (wherein $G^{11}$ represents hydrogen or a group which forms a hydroxyl group upon being hydrolyzed, and $G^{12}$ represents hydrogen, an alkyl group containing 1 to 22 carbon atoms or a hydrolyzable group);

Ball represents a ballast group; and b represents an integer of 0, 1 or 2.

Specific examples of this type of Y are described in Japanese Patent Application (OPI) Nos. 33826/73 and 50736/78.

Other exampls of Y suited for this type of compound are those represented by the following general formula (CIII):

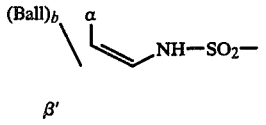

(CIII)

wherein Ball, α and b are the same as defined with (CII), β' represents atoms necessary for forming a carbon ring (e.g., a benzene ring which may be fused with another carbon ring or a hetero ring to form a naphthalene ring, quinoline ring, 5,6,7,8-tetrahydronaphthalene ring, chroman ring or the like. Specific examples of this type of Y are described in Japanese Patent Application (OPI) Nos. 113624.76, 12642/81, 16130/81, 4043/82 and 650/82 and U.S. Pat. No. 4,053,312.

Further examples of Y suited for this type of compound are those represented by the following formula (CIV):

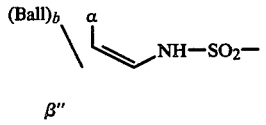

(CIV)

wherein Ball, α and b are the same as defined with the formula (CII), and β'' represents atoms necessary for forming a hetero ring such as a pyrazole ring, a pyridine ring or the like, said hetero ring being optionally bound to a carbon ring or a hetero ring. Specific examples of this type of Y are described in Japanese Patent Application (OPI) No. 104343/76.

Still further examples of Y suited for this type of compound are those represented by the following formula (CV):

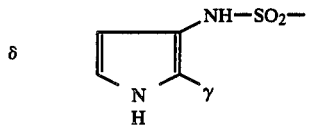

(CV)

wherein $\gamma$ preferably represents hydrogen, a substituted or unsubstituted alkyl, aryl or heterocyclic group, or —CO—$G^{21}$; $G^{21}$ represents —$OG^{22}$, —$SG^{22}$ or

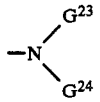

(wherein $G^{22}$ represents hydrogen, an alkyl group, a cycloalkyl group or an aryl group, $G^{23}$ is the same as defined for said $G^{22}$, or $G^{23}$ represents an acyl group derived from an aliphatic or aromatic carboxylic or sulfonic acid, and $G^{234}$ represents hydrogen or an unsubstituted or substituted alkyl group); and $\delta$ represents a residue necessary for completing a fused benzene ring.

Specific examples of this type of Y are described in Japanese Patent Application (OPI) Nos. 104343/76, 46730/78, 130122/79 and 85055/82.

Still further examples of Y suited for this type of compound are those represented by the formula (CVI):

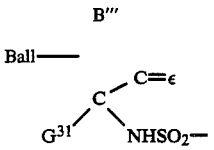

(CVI)

wherein Ball is the same as defined with the formula (CII); $\epsilon$ represents an oxygen atom or $=NG^{32}$ (wherein $G^{32}$ represents hydroxyl or an optionally substituted amino group) (examples of $H_2N$—$G^{32}$ to be used for forming the group of $=NG^{32}$ including hydroxylamine, hydrazines, semicarbazides, thiosemicarbazides, etc.); $\beta'''$ represents a saturated or unsaturated nonaromatic 5-, 6- or 7-membered hydrocarbon ring; and $G^{31}$ represents hydrogen or a halogen atom (e.g., a fluorine atom, a chlorine atom, a bromine atom, etc.).

Specific examples of this type of Y are described in Japanese Patent Application (OPI) Nos. 3819/78 and 48534/79.

Other examples of Y of this type of compound are described in Japanese Patent Publication Nos. 32129/73, 39165/73, Japanese Patent Application (OPI) No. 64436/74, U.S. Pat. No. 3,443,934, etc.

Still further examples of Y are those represented by the following formula (CVII):

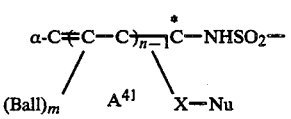

(CVII)

wherein $\alpha$ represents $OR^{41}$ or $NHR^{42}$; $R^{41}$ represents hydrogen or a hydrolyzable component; $R^{42}$ represents hydrogen, or an alkyl group containing 1 to 50 carbon atoms; $A^{41}$ represents atoms necessary for forming an aromatic ring; Ball represents an organic immobile group existing on the aromatic ring, with Ball's being the same or different from each other; m represents an integer of 1 or 2; X represents a divalent organic group having 1 to 8 atoms, with the nucleophilic group (Nu) and an electrophilic center (asterisked carbon atom) formed by oxidation forming a 5- to 12-membered ring; Nu represents a nucleophilic group; n represents an integer of 1 or 2; and $\alpha$ may be the same as defined with the above described formula (CII). Specific examples of this type Y are described in Japanese Patent Application (OPI) No. 20735/82.

As still further type of examples represented by the formula (CI), there are dye providing nondiffusible substances which release a diffusible dye in the presence of a base as a result of self cyclization or the like but which, when reacted with an oxidation product of a developing agent, substantially never release the dye.

Examples of Y effective for this type of compound are those which are represented by the formula (CVIII):

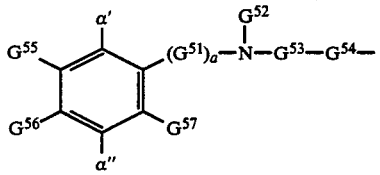

(CVIII)

wherein $\alpha'$ represents an oxidizable nucleophilic group (e.g., a hydroxy group, a primary or secondary amino group, a hydroxyamino group, a sulfonamido group or the like) or a precursor thereof;

$\alpha''$ represents a dialkylamino group or an optional group defined for $\alpha'$;

$G^{51}$ represents an alkylene group having 1 to 3 carbon atoms;

a represents 0 or 1;

$G^{52}$ represents a substituted or unsubstituted alkyl group having 1 to 4 carbon atoms or a substituted or unsubstituted aryl group having 6 to 40 carbon atoms;

$G^{53}$ represents an electrophilic group such as —CO— or —CS—;

$G^{54}$ represents an oxygen atom, a sulfur atom, a selenium atom, a nitrogen atom or the like and, when $G^{54}$ represents a nitrogen atom, it has hydrogen or may be substituted by an alkyl or substituted alkyl group having 1 to 10 carbon atoms or an aromatic residue having 6 to 20 carbon atoms; and $G^{55}$, $G^{54}$ and $G^{57}$ each represents hydrogen, a halogen atom, a carbonyl group, a sulfamyl group, a sulfonamido group, an alkyloxy group having 1 to 40 carbon atoms or an optional group defined for $G^{52}$, $G^{55}$ and $G^{56}$ may form a 5- to 7-membered ring, and $G^{56}$ may represent

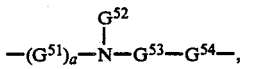

with the proviso that at least one of $G^{52}$, $G^{55}$, $G^{56}$ and $G^{57}$ represents a ballast group. Specific examples of this type of Y are described in Japanese Patent Application (OPI) No. 63618/76.

Further examples of Y suited for this type of compound are those which are represented by the following general formulae (CIX) and (CX):

(CIX)

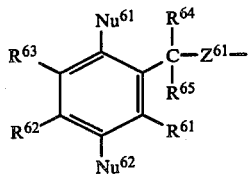

(CX)

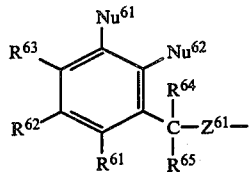

wherein $Nu^{61}$ and $Nu^{62}$, which may be the same or different, each represents a nucleophilic group or a precursor thereof; $Z^{61}$ represents a divalent atom group which is electrically negative with respect to the carbon atom substituted by $R^{64}$ and $R^{65}$; $R^{61}$, $R^{62}$ and $R^{63}$ each represents hydrogen, a halogen atom, an alkyl group, an alkoxy group or an acylamino group or, when located at adjacent positions on the ring, $R^{61}$ and $R^{62}$ may form a fused ring together with the rest of the molecule, or $R^{62}$ and $R^{63}$ may form a fused ring together with the rest of the molecule; $R^{64}$ and $R^{65}$, which may be the same or different, each represents hydrogen, a hydrocarbon group or a substituted hydrocarbon group; with at least one of the substituents, $R^{61}$, $R^{62}$, $R^{63}$, $R^{64}$ and $R^{65}$ having a ballast group, Ball, of an enough size so as to render the above described compounds immobile. Specific examples of this type of Y are described in Japanese Patent Application (OPI) Nos. 69033/78 and 130927/79.

Further examples of Y suited for this type of compound are those which are represented by the formula (CXI):

(CXI)

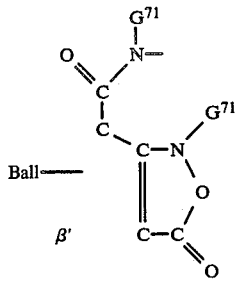

wherein Ball and $\beta'$ are the same as defined for those in formula (CIII), and $G^{71}$ represents an alkyl group (including a substituted alkyl group). Specific examples of this type of Y are described in Japanese Patent Application (OPI) Nos. 111628/74 and 4819/77.

As different type of compound represented by the general formula (CI), there are illustrated dye providing nondiffusible substances which themselves do not release any dye but, upon reaction with a reducing agent, release a dye. With these compounds, compounds which mediate the redox reaction (called electron donors) are preferably used in combination.

Examples of Y effective for this type of compound are those represented by the formula (CXII):

(CXII)

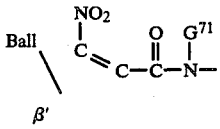

wherein Ball and $\beta'$ are the same as defined for those in the general formula (CIII), and $G^{71}$ represents an alkyl group (including a substituted alkyl group). Specific examples of this type of Y are described in Japanese Patent Application (OPI) Nos. 35533/78 and 110827/78.

Further examples of Y suited for this type of compound are those which are represented by (CXIII):

(CXIII)

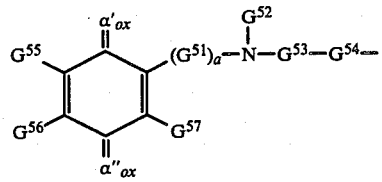

wherein $\alpha'_{ox}$ and $\alpha''_{ox}$ represent groups capable of giving $\alpha'$ and $\alpha''$, respectively, upon reduction, and $\alpha'$, $\alpha''$, $G^{51}$ $G^{52}$, $G^{53}$, $G^{54}$, $G^{55}$, $G^{56}$, $G^{57}$ and a are the same as defined with respect to formula (CVIII). Specific examples of Y described above are described in Japanese Patent Application (OPI) No. 110827/78, U.S. Pat. Nos. 4,356,249 and 4,358,525.

Further examples of Y suited for this type of compound are those which are represented by the formulae (CXIV-A) and (CXIV-B):

(CXIV-A)

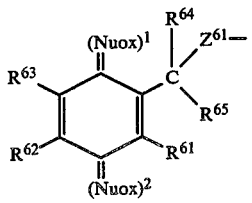

(CXIV-B)

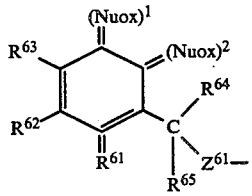

wherein $(Nuox)^1$ and $(Nuox)^2$, which may be the same or different, each represents an oxidized nucleophilic group, and other notations are the same as defined with respect to the formulae (CIX) and (CX). Specific examples of this type of Y are described in Japanese Patent Application (OPI) Nos. 130927/79 and 164342/81.

The publicly known documents having been referred to with respect to (CXII), (CXIII), (CXIV-A) and (CXIV-B) describe electron donors to be used in combination.

As still further different type of compound represented by the general formula (CI), there are illustrated LDA compounds (Linked Donor Acceptor Compounds). These compounds are dye providing non-diffusible substances which cause donor-acceptor reaction in the presence of a base to release a diffusible dye but, upon reaction with an oxidation product of a developing agent, they substantially do not release the dye any more.

Examples of Y effective for this type of compound are those represented by the formula (CXV) (specific examples thereof being described in Japanese Patent Application (OPI) No. 60289/83):

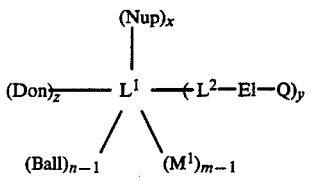

(CXV)

wherein n, x, y and z each represents 1 or 2, m represents an integer of 1 or more; Don represents a group containing an electron donor or its precursor moiety; $L^1$ represents an organic group linking Nup to —$L^2$—El—Q or Don; Nup represents a precursor of a nucleophilic group; El represents an electrophilic center; Q represents a divalent group; Ball represents a ballast group; $L^2$ represents a linking group; and $M^1$ represents an optional substituent.

The ballast group is an organic ballast group which can render the dye providing substance non-diffusible, and is preferably a group containing a $C_{8-32}$ hydrophobic group. Such organic ballast group is bound to the dye providing substance directly or through a linking group (e.g., an imino bond, an ether bond, a thioether bond, a carbonamido bond, a sulfonamido bond, a ureido bond, an ester bond, an imido bond, a carbamoyl bond, a sulfamoyl bond, etc., and combination thereof).

Two or more kinds of the dye providing substances can be employed together. In such a case two or more kinds of the dye providing substances may be used together in order to provide the same hue or in order to reproduce black color.

The dye providing redox compound used in the present invention can be introduced into a layer of the light-sensitive material by known methods such as the method as described in U.S. Pat. No. 2,322,027. In this case, an organic solvent having a high boiling point or an organic solvent having a low boiling point as described below can be used. For example, the dye releasing redox compound is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye providing substance is dispersed in a hydrophilic colloid. For this purpose, the surface active agents illustrated in other part of the specification can be used.

In the present invention, if necessary, a reducing agent may be used. The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

The silver halide used in the present invention includes silver chloride, silver chlorobromide, silver chloroiodide, silver bromide, silver iodobromide, silver chloroiodobromide and silver iodide, etc.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* The Fourth Edition, Chapter 5, pages 149–169.

In the particularly preferred embodiment of the present invention, an organic silver salt oxidizing agent is used together. The organic silver salt oxidizing agent is a silver salt which forms a silver image by reacting with the above described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the light-sensitive material which provides higher color density can be obtained.

Examples of such organic silver salt oxidizing agent include those described in U.S. Pat. No. 4,500,626.

A silver salt of an organic compound having a carboxyl group can be used. Typical examples thereof include a silver salt of an aliphatic carboxylic acid and a silver salt of an aromatic crboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotrazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbozole, a silver salt of saccharin, a silver salt of imidzole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

The light-sensitive material of the present invention can contain a toning agent as occasion arises. Effective toning agents are 1,2,4-traizoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The contact of such a toning agent as described above, through depending upon the kind of a heat developable light-sensitive material used, processing conditions, desired images and various other factors, generally ranges from about 0.001 to 0.1 mol per mol of silver in the photosensitive material.

The above described bases or base precursors can be used not only for the acceleration of dye release but also for other purposes such as the control of a pH value.

The above described various ingredients to constitute a heat developable light-sensitive material can be arranged in arbitrary positions, if desired. For instance, one or more of the ingredients can be incoporated in one or more of the constituent layers of a light-sensitive material, if desired. In some cases, it is desired that particular portions of reducing agent, image stabilizing agent and/or other additives should be distributed in a protective layer. As a result of the distribution in the above described manner, migration of additives among constituent layers of a heat developable light-sensitive material can be reduced. Therefore, such distribution of additives is of advantage to some cases.

The heat developable light-sensitive materials of the present invention are effective in forming both negative and positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 2,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by imagewise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light emitting diodes, etc.

In the present invention, after the heat developable color photographic material is exposed to light, the resulting latent image can be developed by heating the whole material to a suitably elevated temperatures. A higher temperature or lower temperature can be utilized to prolong or shorten the heating time, if it is within the above described temperature range.

As the heating means, a simple heat plate, iron, heat roller, heat generator utilizing carbon or titanium white, etc., or analogues thereof may be used.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, stytyl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei fomred by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazoline-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publications Nos. 4936/68 and 12375/78, Japanese Patent Application (OPI) Nos. 110618/77 and 109925/77, etc.

These sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the light-sensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinyl-sulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used alone or as a combination thereof.

The transfer of dyes from the light-sensitive layer to the dye fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of cyrstallization or microcapsules or as a precursor which releases a solvent at a high temperature.

More preferred process is a process wherein a hydrophilic thermal solvent which is solid at am ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the interlayer, the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes and other heterocyclic compounds.

Base precursors used are compounds which undergo a certain reaction by heating to release a base, such as organic acid base salts which undergo decarboxylation to decompose by heating, and compounds which are decomposed by an intramolecular nucleophilic displacement reaction, Lossen rearrangement and Beckmann rearrangement to release an amine. Preferred base precursors include salts of trichloroacetic acid compounds described in British Pat. No. 998,949, salts of α-sulfonylacetic acid compounds described in U.S. Pat. No. 4,060,420, salts of propiolic acid compounds described in Japanese Patent Application (OPI) No. 180537/84, derivatives of 2-carboxy-carboxyamides described in U.S. Pat. No. 4,008,496, salts of an acid decomposable by heating and a base such as an organic base, an alkali metal atom and an alkali earth metal atom (described in Japanese Patent Application (OPI) No. 195237/84, hydroxame-carbamate compounds decomposable by Lossen rearrangement described in Japanese Patent Application No. 43860/83, aldoxime-carbamate compounds forming nitriles by heating described in Japanese Patent Application (OPI) No. 157637/84 and so on.

Useful base precursors also include compounds described in British Pat. No. 998,945, U.S. Pat. No. 3,220,846, Japanese Patent Application No. 22625/75 and British Pat. No. 2,079,480.

Other compounds which can be used in the light-sensitive material of the present invention, for example, sulfamide derivatives, cationic compounds containing a pyridinium group, surface active agents having polyethylene oxide chains, sensitizing dye, antihalation and antiirradiation dyes, hardeners, mordants and so on, are those described in U.S. Pat. Nos. 4,500,626, 4,478,927, 4,463,079, and Japanese Patent Application Nos. 28928/83 (corresponding to U.S. patent application Ser. No. 582,655, filed on Feb. 23, 1984) and U.S. Pat. No. 4,503,137. Methods for the exposure and so on cited in the above described patents can be employed in the present invention also.

The heat developable light-sensitive material of the present invention has a very good storage stability because of using a development-accelerating agent which is not basic and is stable at room temperature. The heat developable light-sensitive material of the present invention can also provide an image having good quality and a high S/N ratio by developing for a short time because of being able to accelerate development by heating.

The present invention is described in detail by examples below, but the present invention is not limited thereto.

Unless otherwise specified, all percents, ratios, etc. are by weight.

EXAMPLE 1

Preparation of Silver Iodobromide Emulsion 40 g of gelatin and 26 g of KBr were dissolved in 3,000 ml of water, and the resulting solution was stirred while maintaining it at 50° C. A solution of 34 g of silver nitrate dissolved in 200 ml of water was added to the above solution for 10 minutes. Then, a solution of 3.3 g of KI dissolved in 100 ml of water was added to the solution for 2 minutes. The thus prepared silver iodobromide emulsion was adjusted in pH, precipitated and freed of excess salts. It was then adjusted to pH 6.0, whereby 400 g of a silver iodobromide emulsion was obtained.

Preparation of a Gelatin Dispersion of Dye Providing Substance 10 g of a dye providing substance having the following formula:

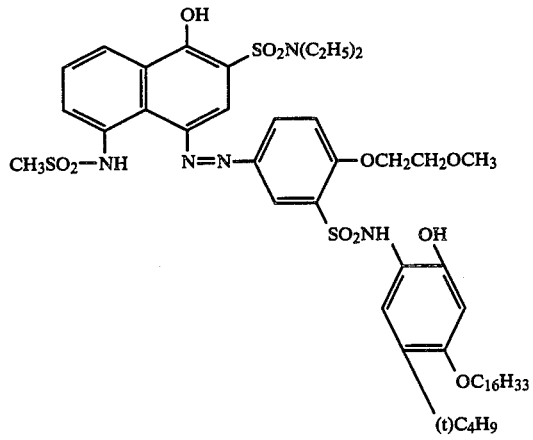

0.5 g of succinic acid 2-ethylhexyl ester sulfonic acid sodium salt as a surface active agent, and 20 g of tricresyl phosphate (TCP) were weighted out, and 30 ml of ethyl acetate was added thereto. They were then dissolved in the ethyl acetate by heating at about 60° C. The resulting solution was added to 100 g of a 10 wt% solution of gelatin, stirred, and dispersed for 10 minutes by means of a homogenizer at 10,000 rpm. The thus formed dispersion is hereafter referred to as the "dispersion of the dye providing substance".

Preparation of Light-Sensitive Coating Material

| | | |
|---|---|---|
| (a) | Light-sensitive silver iodobromide | 25 g |
| (b) | Dispersion of the dye providing substance | 33 g |
| (c) | 5% Aqueous solution of a compound having the following formula | 10 ml |

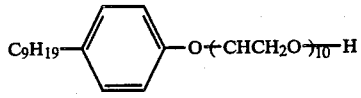

| | | |
|---|---|---|
| (d) | Solution of 1.5 g of guanidine trichloroacetic acid dissolved in 15 ml of ethanol | |
| (e) | Solution of 0.4 g of $(CH_3)_2NSO_2NH_2$ dissolved in 4 ml of methanol | |
| (f) | Solution of 0.2 g of Compound (1) of the present invention dissolved in 4 ml of methanol | |

The above components (a) to (f) were mixed and dissolved by heating. The resulting solution was then coated on a 180 μm thick polyethylene terephthalate film in a wet thickness of 30 μm and dried. On the thus formed layer was further coated the following composition in a wet thickness of 25 μm to thereby form a protective layer.

Composition of Protective Layer

| | |
|---|---|
| 10 wt % Aqueous solution of gelatin | 30 g |
| Water | 70 ml |

The above prepared light-sensitive material was dried and exposed imagewise for 10 seconds by use of a tungsten lamp at 2,000 lux. The material was then uniformly heated for 20 seconds on a heat block maintained at 140° C. The resultant material is hereafter referred to as Sample A.

Another light-sensitive material, Sample B, was prepared in the same manner as above, except that as the ingredient (f), only 4 ml of methanol (not containing compound (1)) was used. This material was processed in the same manner as above.

Preparation of Dye Fixing Material with Dye Fixing Layer 10 g of a methyl acrylate/N,N,N-trimethyl-N-vinylbenzylammonium chloride (1/1) copolymer was dissolved in 200 ml of water and then uniformly mixed with 100 g of 10% lime-treated gelatin. The resulting mixture was uniformly coated in a wet thickness of 90 μm on a paper support laminated with polyethylene. The thus prepared material was dried and used as a dye fixing material.

The dye fixing material was dipped in water, and then removed from water. The above heated light-sensitive materials, Sample A and B, were superposed on separate pieces of the dye fixing material in such a manner that the coatings came into contact with each other.

They were then heated for 6 seconds on a heat block maintained at 80° C. Then, the dye fixing material was separated from the light-sensitive material, whereupon a negative magenta dye image was formed on the dye fixing material. The density of the negative image was measured with a Macbeth transmission densitometer (TD-504). The results are shown in Table 1 below.

TABLE 1

| Sample | Maximum Density | Minimum Density |
|---|---|---|
| A (Example of the Invention) | 2.05 | 0.18 |
| B (Comparative Example) | 1.03 | 0.18 |

It can be seen from the results of Table 1 that if the compound of the present invention is used, the maximum density can be greatly increased without a substantial increase in the minimum density, comparing with the comparative example not containing compound of the present invention.

EXAMPLE 2

The procedure of EXAMPLE 1 was repeated wherein each compound shown in Table 2 was used in place of Compound (1). The results are shown in Table 2.

TABLE 2

| Sample No. | Used Compound No. | Amount | $D_{max.}$ | $D_{min.}$ |
|---|---|---|---|---|
| C | Compound (3) | 0.25 g | 2.06 | 0.19 |
| D | Compound (8) | 0.27 g | 2.03 | 0.18 |
| E | Compound (10) | 0.28 g | 2.02 | 0.19 |
| F | Compound (11) | 0.30 g | 2.03 | 0.20 |

It can be seen from the results of Table 2 that if the compounds of the present invention are used, the maximum density can be greatly increased without a substantial increase in the minimum density.

EXAMPLE 3

Dye providing substance dispersion α and β were prepared in the same manner as in EXAMPLE 1, except that in place of the dye providing substance of EXAMPLE 1, dye providing substances having the following formulae were each used in an amount of 10 g each.

Dye Providing Substance for Dispersion α

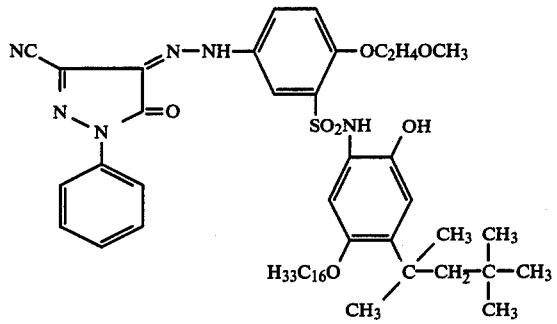

Dye Providing Substance for Dispersion β

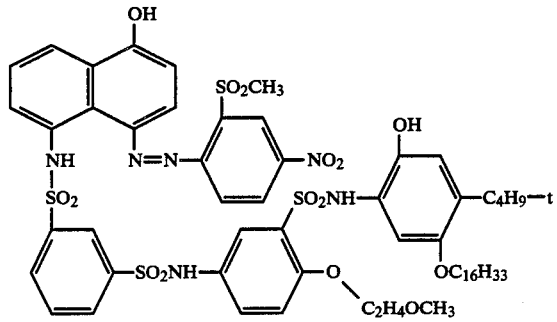

Thereafter, the same procedure as in EXAMPLE 1 was repeated. The results are shown in Table 3.

TABLE 3

| Dye Providing Substance Dispersion | Compound (1) | Maximum Density | Minimum Density |
|---|---|---|---|
| Dispersion α | Present | 1.22 | 0.11 |
| | Not present | 0.65 | 0.11 |
| Dispersion β | Present | 2.19 | 0.19 |
| | Not present | 1.15 | 0.20 |

It can be seen from the results of Table 3 that the compound of the present invention provides a very high maximum density.

EXAMPLE 4

The emulsion prepared as described below was used in place of the emulsion of EXAMPLE 1.

6.5 g of benzotriazole and 10 g of gelatin were dissolved in 1,000 ml of water, and the resulting solution was stirred while maintaining it at 50° C. A solution of 8.5 g of silver nitrate dissolved in 100 ml of water was added to the above solution for 2 minutes.

A solution of 1.2 g of potassium bromide dissolved in 50 ml of water was added to the above solution for 2 minutes. The thus formed emulsion was adjusted in pH, precipitated and freed of excess salts. Then, the emulsion was adjusted to pH 6.0 (yield, 200 g).

Preparation of Light-sensitive Coating Material

| | | |
|---|---|---|
| (a) | Benzotriazole silver emulsion containing light-sensitive silver bromide | 10 g |
| (b) | Dye providing substance dispersion (same as used in EXAMPLE 1) | 3.5 g |
| (c) | Solution of 0.35 g of a compound having the formula shown below described in 3 ml of a water/ethanol (50/50 by volume) mixture | 1.5 ml |

-continued

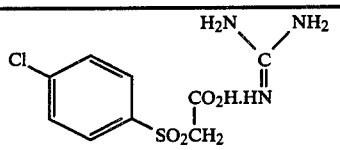

(d) 5 wt % Aqueous solution of a compound having the following formula — 1.5 ml

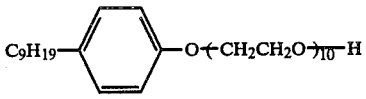

(e) Solution of 0.3 g of $(CH_3)_2NSO_2NH_2$ dissolved in 4 ml of ethanol (f) Solution of 0.25 g of Compound (3) of the present invention dissolved in 4 ml of ethanol The above ingredients (a) to (f) were mixed. Thereafter the same procedure as in EXAMPLE 1 was repeated. The results are shown in Table 4 below.

TABLE 4

| Sample | Maximum Density | Minimum Density |
|---|---|---|
| Containing Compound (2) (Example of the Invention) | 2.05 | 0.19 |
| Not containing Compound (2) (Comparative Example) | 1.10 | 0.18 |

It can be seen from the results of Table 4 that if the compound of the present invention is used, a high maximum density can be obtained.

EXAMPLE 5

The same emulsion as in EXAMPLE 4 was prepared.

A dye providing substance dispersion was prepared in the same manner as in EXAMPLE 1, except that in place of the dye providing substance of EXAMPLE 1, the dye providing substance having the following formula were used in an amount of 10 g.

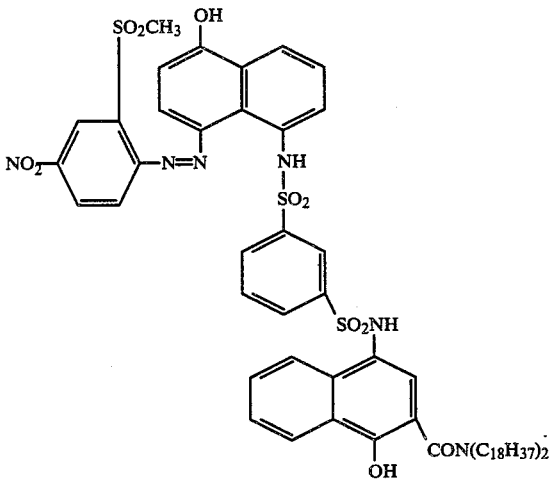

Preparation of Light-Sensitive Coating Material

| | | |
|---|---|---|
| (a) | Benzotriazole silver emulsion containing light-sensitive silver bromide (same as used in EXAMPLE 4) | 10 g |
| (b) | Dye providing substance dispersion | 3.5 g |

-continued (c) Solution of 0.25 g of Compound (8) dissolved in 4 ml of ethanol (d) Solution of 0.2 g of a compound having the formula as shown below dissolved in 4 ml of water

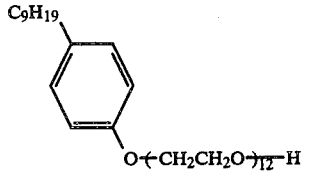

(e) Solution of 0.3 g of $(CH_3)_2NSO_2NH_2$ dissolved in 4 ml of ethanol

The above ingredients (a) to (e) were mixed and then dissolved by heating. The resulting solution was coated on a 180 μm thick polyethylene terephthalate film in a wet thickness of 30 μm. The thus produced light-sensitive material was dried and then exposed imagewise for 10 seconds by use of a tungsten lamp at 2,000 lux. The material was then uniformly heated for 30 seconds on a heat block maintained at 160° C. The resultant material is hereafter referred to as Sample G.

Another light-sensitive material, Sample H, was prepared in the same manner as above, except that as the ingredient (c), only 4 ml of ethanol was used; Compound (8) was not added. This material was processed in the same manner as above.

A dye fixing material was prepared in the same manner as in EXAMPLE 1. Thereafter, the same procedure as in EXAMPLE 1 was repeated. The results are shown in Table 5 below.

TABLE 5

| Sample No. | Maximum Density | Minimum Density |
|---|---|---|
| G (Example of the Invention) | 1.49 | 0.23 |
| H (Comparative Example) | 0.85 | 0.22 |

It can be seen from the results of Table 5 that if the compound of the present invention is used, the maximum density is increased compared with the case in which it is not used.

While the invention has been described in detail and with reference to specific embodiments thereof, it will be apparent to one skilled in the art that various changes and modifications can be made therein without departing from the spirit and scope thereof.

What is claimed is:

1. A heat developable color photographic light-sensitive material comprising a support having thereon a dye image forming compound and at least one layer containing a compound represented by the formula:

$$R—C\equiv C—M_{1/k}$$

wherein R represents an unsubstituted or substituted group selected from an alkyl group, a cycloalkyl group, an alkenyl group, an alkynyl group, an aralkyl group, an aryl group and a heterocyclic group; M represents a hydrogen atom or a transition metal atom; and k is an integer of 1 to 3, wherein a silver halide emulsion is present as a light-sensitive substance.

2. A heat developable color light-sensitive material as claimed in claim 1, wherein R represents a phenyl group or a substituted phenyl group.

3. A heat developable color light-sensitive material as claimed in claim 1, wherein the silver halide emulsion is spectrally sensitized.

* * * * *